US005980259A

United States Patent [19]

Witmer

[11] Patent Number: 5,980,259

[45] Date of Patent: Nov. 9, 1999

[54] DUMMY FOR WATER RESCUE PRACTICE

[76] Inventor: Alexis Witmer, 460 Foxen Dr., Santa Barbara, Calif. 93105

[21] Appl. No.: 09/039,254

[22] Filed: Mar. 16, 1998

[51] Int. Cl.[6] ..... A63B 69/10; B63B 22/20; B63C 9/08

[52] U.S. Cl. ..... 434/254; 434/256; 441/23; 441/80

[58] Field of Search ..... 434/254, 256, 434/265; 441/1, 11, 21, 23, 26, 80; 446/153, 155, 156; 472/128, 129

[56] References Cited

U.S. PATENT DOCUMENTS

| | | | |
|---|---|---|---|
| 1,676,884 | 7/1928 | Belden | 446/153 |
| 3,203,694 | 8/1965 | Kobasikawa | 472/129 |
| 3,760,441 | 9/1973 | Handelman | 441/11 |
| 3,805,667 | 4/1974 | Orser | 87/6 |
| 4,857,026 | 8/1989 | Hull | 441/65 |
| 5,273,468 | 12/1993 | Nichols | 441/6 |
| 5,505,645 | 4/1996 | Engler, Jr. | 441/1 |
| 5,722,871 | 3/1998 | Zamir | 446/153 |

FOREIGN PATENT DOCUMENTS

| | | | |
|---|---|---|---|
| 16732 | 8/1910 | United Kingdom | 446/153 |

*Primary Examiner*—Robert A. Hafer
*Assistant Examiner*—Kurt Fernstrom

[57] ABSTRACT

A new dummy for water rescue practice for facilitating the honing by sailors of skills necessary for the successful rescue of a person fallen overboard. The inventive device includes a hollow, air-tight head portion having a top section, a neck section, and a bottom section, the neck section being disposed intermediate the top section and the bottom section, a pole having an upper section and a lower section, the pole upper section being perpendicularly and fixedly attached to a bottom section lower portion, a weight fixedly attached to the pole lower section, and a rope releasably attachable to the bottom section.

8 Claims, 2 Drawing Sheets

DUMMY FOR WATER RESCUE PRACTICE

BACKGROUND OF THE INVENTION

1. Field of the Invention

The present invention relates to dummies and more particularly pertains to a new dummy for water rescue practice for facilitating the honing by sailors of skills necessary for the successful rescue of a person fallen overboard.

2. Description of the Prior Art

The use of dummies is known in the prior art. More specifically, dummies heretofore devised and utilized are known to consist basically of familiar, expected and obvious structural configurations, notwithstanding the myriad of designs encompassed by the crowded prior art which have been developed for the fulfillment of countless objectives and requirements.

Known prior art dummies include U.S. Pat. No. 5,335,906 and U.S. Pat. No. 5,320,571.

While these devices fulfill their respective, particular objectives and requirements, the aforementioned patents do not disclose a new dummy for water rescue practice. The inventive device includes a hollow, air-tight head portion having a top section, a neck section, and a bottom section, the neck section being disposed intermediate the top section and the bottom section; a pole having an upper section and a lower section, the pole upper section being perpendicularly and fixedly attached to a lower portion of the bottom section of the head portion; a weight fixedly attached to the pole lower section; and a rope releasably attachable to the bottom section of the head portion.

In these respects, the dummy for water rescue practice according to the present invention substantially departs from the conventional concepts and designs of the prior art, and in so doing provides an apparatus primarily developed for the purpose of facilitating the honing by sailors of skills necessary for the successful rescue of a person fallen overboard.

SUMMARY OF THE INVENTION

In view of the foregoing disadvantages inherent in the known types of dummies now present in the prior art, the present invention provides a new dummy for water rescue practice construction wherein the same can be utilized for facilitating the honing by sailors of skills necessary for the successful rescue of a person fallen overboard.

The general purpose of the present invention, which will be described subsequently in greater detail, is to provide a new dummy for water rescue practice apparatus and method which has many of the advantages of the dummies mentioned heretofore and many novel features that result in a new dummy for water rescue practice which is not anticipated, rendered obvious, suggested, or even implied by any of the prior art dummies, either alone or in any combination thereof.

To attain this, the present invention generally comprises a hollow, air-tight head portion having a top section, a neck section, and a bottom section, the neck section being disposed intermediate the top section and the bottom section; a pole having an upper section and a lower section, the pole upper section being perpendicularly and fixedly attached to a bottom section lower portion; a weight fixedly attached to the pole lower section; and a rope releasably attachable to the bottom section. The head portion is designed to float upon the surface of a body of water in a generally upright position counterweighted by the weight. The rope is designed to float upon the surface of the water and be engageable by a boat hook manipulated by a sailor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dummy for water rescue practice apparatus and method which has many of the advantages of the dummies mentioned heretofore and many novel features that result in a new dummy for water rescue practice which is not anticipated, rendered obvious, suggested, or even implied by any of the prior art dummies, either alone or in any combination thereof.

It is another object of the present invention to provide a new dummy for water rescue practice which may be easily and efficiently manufactured and marketed.

It is a further object of the present invention to provide a new dummy for water rescue practice which is of a durable and reliable construction.

An even further object of the present invention is to provide a new dummy for water rescue practice which is susceptible of a low cost of manufacture with regard to both materials and labor, and which accordingly is then susceptible of low prices of sale to the consuming public, thereby making such dummy for water rescue practice economically available to the buying public.

Still yet another object of the present invention is to provide a new dummy for water rescue practice which provides in the apparatuses and methods of the prior art some of the advantages thereof, while simultaneously overcoming some of the disadvantages normally associated therewith.

Still another object of the present invention is to provide a new dummy for water rescue practice for facilitating the honing by sailors of skills necessary for the successful rescue of a person fallen overboard.

Yet another object of the present invention is to provide a new dummy for water rescue practice which includes a hollow, air-tight head portion having a top section, a neck section, and a bottom section, the neck section being disposed intermediate the top section and the bottom section; a pole having an upper section and a lower section, the pole upper section being perpendicularly and fixedly attached to a lower portion of the bottom section of the head portion; a weight fixedly attached to the pole lower section of the head portion; and a rope releasably attachable to the bottom section.

Still yet another object of the present invention is to provide a new dummy for water rescue practice that looks and floats like a real person fallen overboard.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
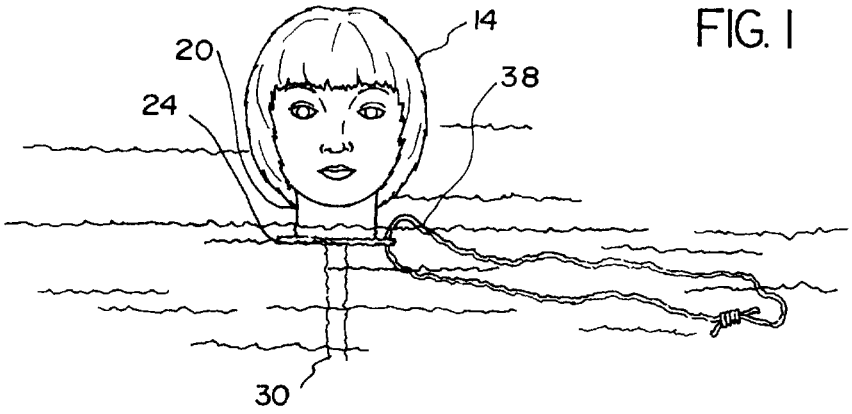
FIG. 1 is a fragmented view of a new dummy for water rescue practice according to the present invention.
Figure 2:
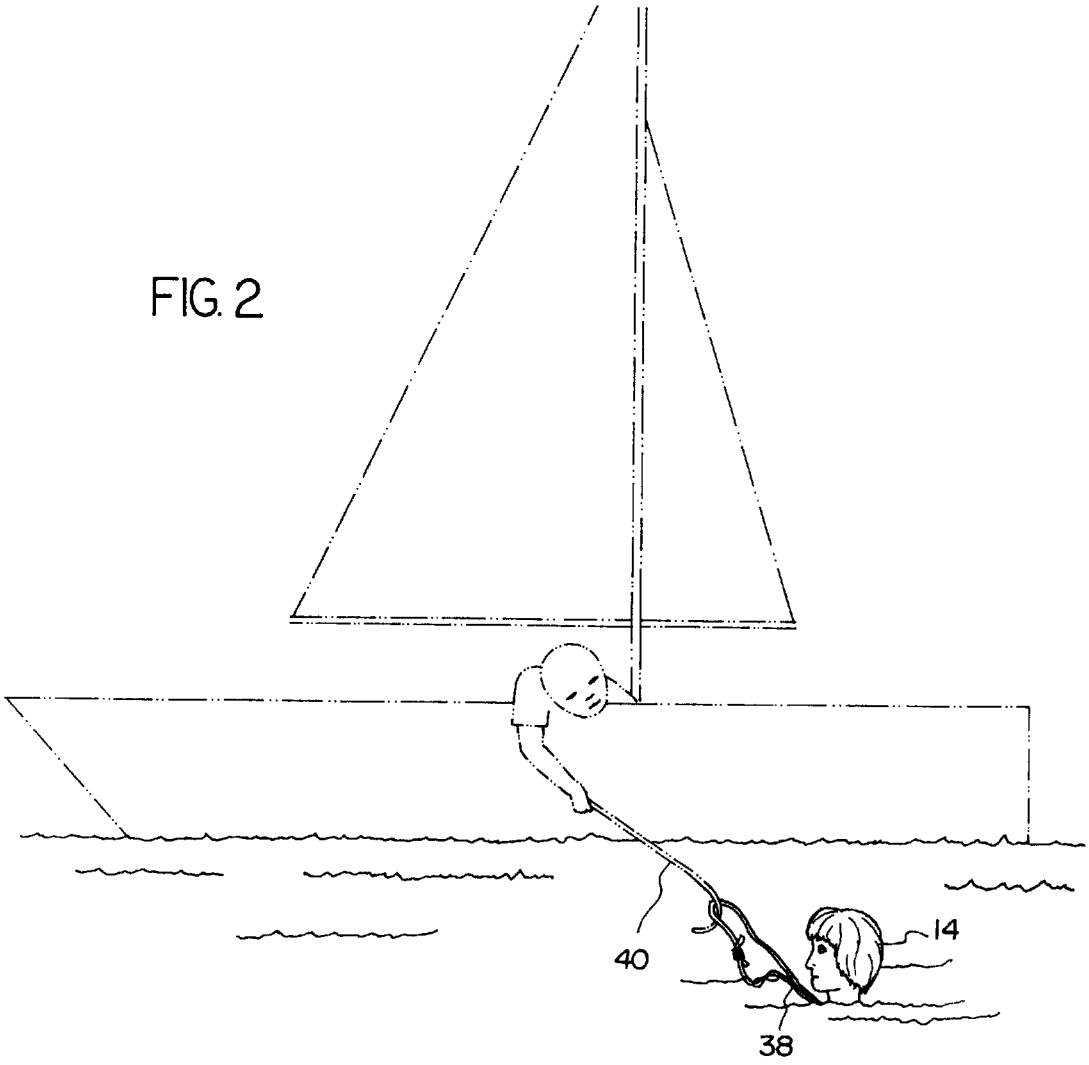
FIG. 2 is a view of the dummy for water rescue practice in use.

With reference now to the drawings, and in particular to FIGS. 1 through 4 thereof, a new dummy for water rescue practice embodying the principles and concepts of the present invention and generally designated by the reference numeral 10 will be described.

More specifically, it will be noted that the dummy for water rescue practice 10 comprises a hollow, air-tight head portion 12 having a top section 14 including a hollow space 13 surrounded by a shell 19, a neck section 20 and a bottom section 24 including an upper portion 25 and a lower portion 26. The head portion 12 is preferably formed of a light-weight material such as plastic to enable the head portion 12 to float upon the surface of a body of water.

Figure 3:
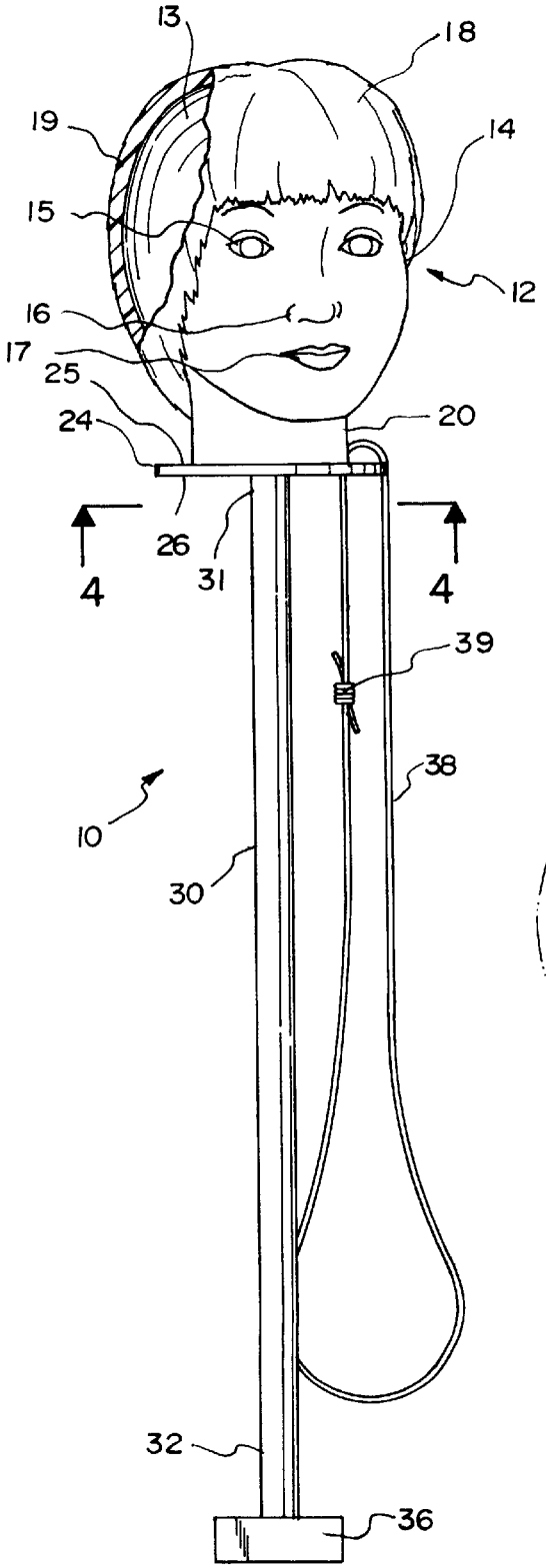
FIG. 3 is a partially sectioned side elevational view of the present invention.
Figure 4:
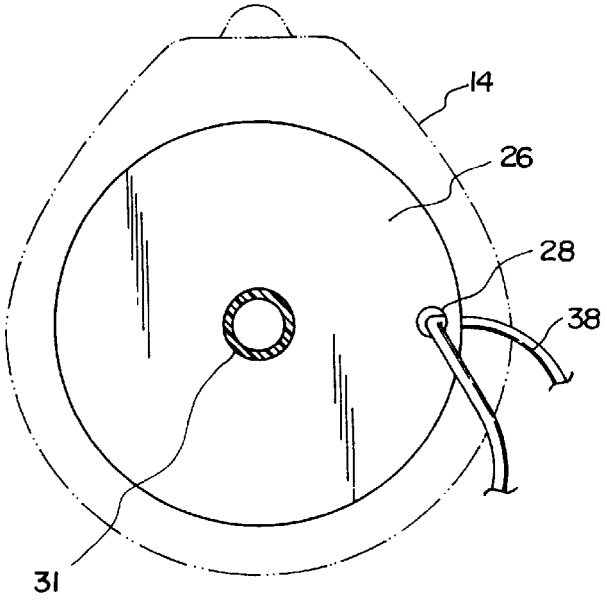
FIG. 4 is a cross sectional view of the invention taken along line 4—4 of FIG. 3.

With reference to FIGS. 3 and 4 there is shown a pole 30 having an upper section 31 and a lower section 32 perpendicularly attached to the lower portion 26 of the bottom section 24 of the head portion 12 at the upper section 31 of the pole 30. The pole 30 is preferably formed of a plastic material and may be attached to lower portion 26 of the bottom section 24 of the head portion 12 by any conventional means including gluing or may be integrally formed to the bottom section 24.

A weight 36 is shown in FIG. 3 attached to the pole lower section 32. The weight is of sufficient mass to hold the head portion 12 in a generally upright position upon the surface of the body of water. In the preferred embodiment, the head portion 12 measures ten inches in heights and the pole 30 measures twenty inches in length. The weight if preferably a one pound weight.

A rope 38 is shown releasably attached to the bottom section 24. An aperture 28 is shown formed in the bottom section 24 of the head portion 12 to receive the rope 38 which is then knotted by knot 39. The rope 38 is preferably formed of polypropylene so that it is buoyant upon the surface of the body of water as shown in FIG. 1.

In order to make the dummy 10 more life-like, the head portion top section 14 further is shown including the features of a human face such as a pair of eyes 15, a nose 16 and a mouth 17. Also shown is a wig 18 which in the preferred embodiment is integrally formed to the head portion top section 14.

In use, the dummy for water rescue practice 10 is thrown in the water to simulate a man over board situation. The sailor then maneuvers the boat to a position in which a boat hook 40 can be used to retrieve the dummy 10 from the water by means of the rope 38.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dummy for water rescue practice comprising:

a hollow, air-tight head portion having a top section, a neck section and a bottom section, the neck section being disposed intermediate the top section and the bottom section of the head portion and having a smaller cross-sectional area than those of the top section and the bottom section of the head portion, wherein the head portion is the uppermost portion of the dummy;

a weight;

a pole having an upper section and a lower section, the pole being disposed intermediate the head portion and the weight, the pole upper section being perpendicularly and fixedly attached to a lower portion of the head portion bottom section;

a rope releasably attachable to the bottom section of the head portion; and wherein the weight is fixedly attached to the pole lower section.

2. The dummy for water rescue practice of claim 1, wherein the head portion top section further comprises the features of a human face.

3. The dummy for water rescue practice of claim 2, wherein the head portion top section further comprises an integral wig.

4. The dummy for water rescue practice of claim 1, wherein the head portion bottom section further comprises an aperture, the aperture being for receiving the rope.

5. The dummy for water rescue practice of claim 1, wherein the rope is a polypropylene rope.

6. The dummy for water rescue practice of claim 1, wherein the head and pole are made of plastic.

7. The dummy for water rescue practice of claim 1, wherein the weight weighs one pound.

8. A dummy for water rescue practice comprising:

a plastic, hollow, air-tight head portion having the features of a human face and having a top section including an integral wig, a neck section and a bottom section, the neck section being disposed intermediate the top section and the bottom section of the head portion and having a smaller cross-sectional area than those of the top section and the bottom section of the head portion, wherein the head portion is the uppermost portion of the dummy;

a one pound weight;

a plastic pole having an upper section and a lower section, the pole being disposed intermediate the head portion and the weight, the pole upper section being perpendicularly and fixedly attached to a lower portion of the head portion bottom section;

a polypropylene rope releasably attachable to the bottom section through an aperture formed therethrough; and wherein the weight is fixedly attached to the pole lower section.

* * * * *